United States Patent [19]

Yamaoka et al.

[11] Patent Number: 4,479,076

[45] Date of Patent: Oct. 23, 1984

[54] POWER SAVING DEVICE FOR ELECTRONIC FLASH

[75] Inventors: Tetsuo Yamaoka, Osaka; Hiroshi Iwata, Nara, both of Japan

[73] Assignee: West Electric Co., Ltd., Osaka, Japan

[21] Appl. No.: 311,611

[22] Filed: Oct. 15, 1981

[30] Foreign Application Priority Data

Oct. 15, 1980 [JP] Japan ..... 55-145017
Feb. 27, 1981 [JP] Japan ..... 56-29156
Feb. 27, 1981 [JP] Japan ..... 56-29157

[51] Int. Cl.[3] ..... H05B 41/32

[52] U.S. Cl. ..... 315/241 P; 315/225; 315/360

[58] Field of Search ..... 315/225, 241 P, 360; 320/1; 354/145

[56] References Cited

U.S. PATENT DOCUMENTS 4,323,822 4/1982 Takematsu ..... 315/225 X

*Primary Examiner*—Eugene R. La Roche
*Attorney, Agent, or Firm*—Burgess, Ryan and Wayne

[57] ABSTRACT

A power saving device for use in a power supply circuit has an electronic switching element which is turned on when a pushbutton normally open type switch is closed to actuate a DC-DC converter and a fully electronic control system which forces the electronic switching element into the non-conduction state after a predetermined time interval, to interrupt the connection of a low-voltage power source to the DC-DC converter.

5 Claims, 4 Drawing Figures

POWER SAVING DEVICE FOR ELECTRONIC FLASH

BACKGROUND OF THE INVENTION

The present invention relates to a power saving device for use in a power supply circuit of the type using a DC-DC converter.

Power supply circuits of the type in which a voltage supplied from a low-voltage power source is stepped up by a DC-DC converter and supplied to a load have been widely used in various electric equipment and especially in small-sized equipment. In general, these power supply circuits are actuated by closing a mechanical start switch such as a slide switch. Therefore, in the case of, for instance, an electronic flash device, it occurs very often that one fails to open the start switch before the electronic flash device is inserted back into its case or put into a pocket. Moreover, even when the start switch is opened, it is very often closed erratically again when it is inserted into the case or put into the pocket. As a result, the power source is wasted for nothing.

In order to overcome this problem, there have been proposed various types of automatic power-supply shutoff devices. In one type, a mechanical switch and the so-called "off" type magnet, which is energized when supplied with a current, are combined with a timer so that after a predetermined time interval, which is set by the timer, the power supply is automatically shut off. More specifically, an electromagnet is operatively combined with a mechanical switch which is normally opened to shut off the supply of power to a DC-DC converter. The electromagnet is energized to force the normally open switch to be closed against its biasing force so that the supply of power to the DC-DC converter can be maintained only for a predetermined time interval. After a predetermined time interval, the electromagnet is de-energized so that the mechanical normally open switch is forced to open by the biasing force. To put into another way, when the magnet is energized the on-off switch is closed so that the power is supplied from the power source to the load. However, depending upon the load, when the magnet is energized, a large current flows into the DC-DC converter from the power source so that the voltage across the power source drops exceedingly to such an extent that the electromagnet cannot be maintained energized. As a consequence, the power supply is interrupted and the electric equipment cannot be activated.

Moreover, there arises another problem. That is, the automatic power-supply shutoff device of the type includes the electromagnet and its control system so that it becomes large in size and complex in construction. Therefore, it is not adapted to be incorporated into small-size electric equipment.

There has been also devised and demonstrated another automatic power-supply shutoff device of the type utilizing a mechanical switch and the so-called "ON" type magnet which is a permanent magnet so designed and arranged as to be demagnetized when the coil mounted thereon is energized. The demagnetization time interval is controlled by a timer circuit. In contrast with the automatic shutoff device of the type utilizing the "off" type magnet, the mechanical switch can be maintained in a desired state by the attractive force of the permanent magnet. When the switch is closed, it can be maintained in the closed state in a stable manner even when a large current is supplied from the power source to the load. However, this type of device also has a drawback. That is, a predetermined time interval which is set by the timer circuit, the demagnetizing current is instantaneously supplied to the demagnetizing coil so that the switch is returned to the open state. Therefore, the permanent magnet is demagnetized many times, its attractive force is so diminished that it cannot hold the switch in the closed state. Moreover, when the power source is used many times, the current cannot be supplied which is sufficient enough to demagnetize the permanent magnet holding the switch and consequently the power is kept supplied. In addition, the permanent magnet used is large in size and expensive. If a poor quality permanent magnet is used for the sake of savings in cost, reliability in operation would be inevitably degraded.

As described above, the prior art power saving devices have various problems as described above and the present invention was made to overcome them.

SUMMARY OF THE INVENTION

One of the objects of the present invention is, therefore, to provide a power saving device for use in a power supply circuit comprising a low-voltage power source and a DC-DC converter which device can permit the supply of power or energy from the power source to the DC-DC converter only for a predetermined time interval.

Another object of the present invention is to provide a power saving device which is of the fully electronic type, that is, which comprises electronic component parts only.

A further object of the present invention is to provide a power saving device provided with a means which can deactivate, without fail, the DC-DC converter a predetermined time after it has been activated.

A yet further object of the present invention is to provide a power saving device which is compact in size and light in weight yet highly reliable in operation so that it is best adapted to be incorporated in a small electric equipment such as an electronic flash device or a camera with a built-in electronic flash system.

A still another object of the present invention is to provide a power saving device provided with a timer circuit which can be controlled in response to the brightness of a subject or object.

BRIEF DESCRIPTION OF THE DRAWINGS

Same reference numerals are used to designate similar parts throughout the figures.

DESCRIPTION OF THE PREFERRED EMBODIMENTS

Figure 1:
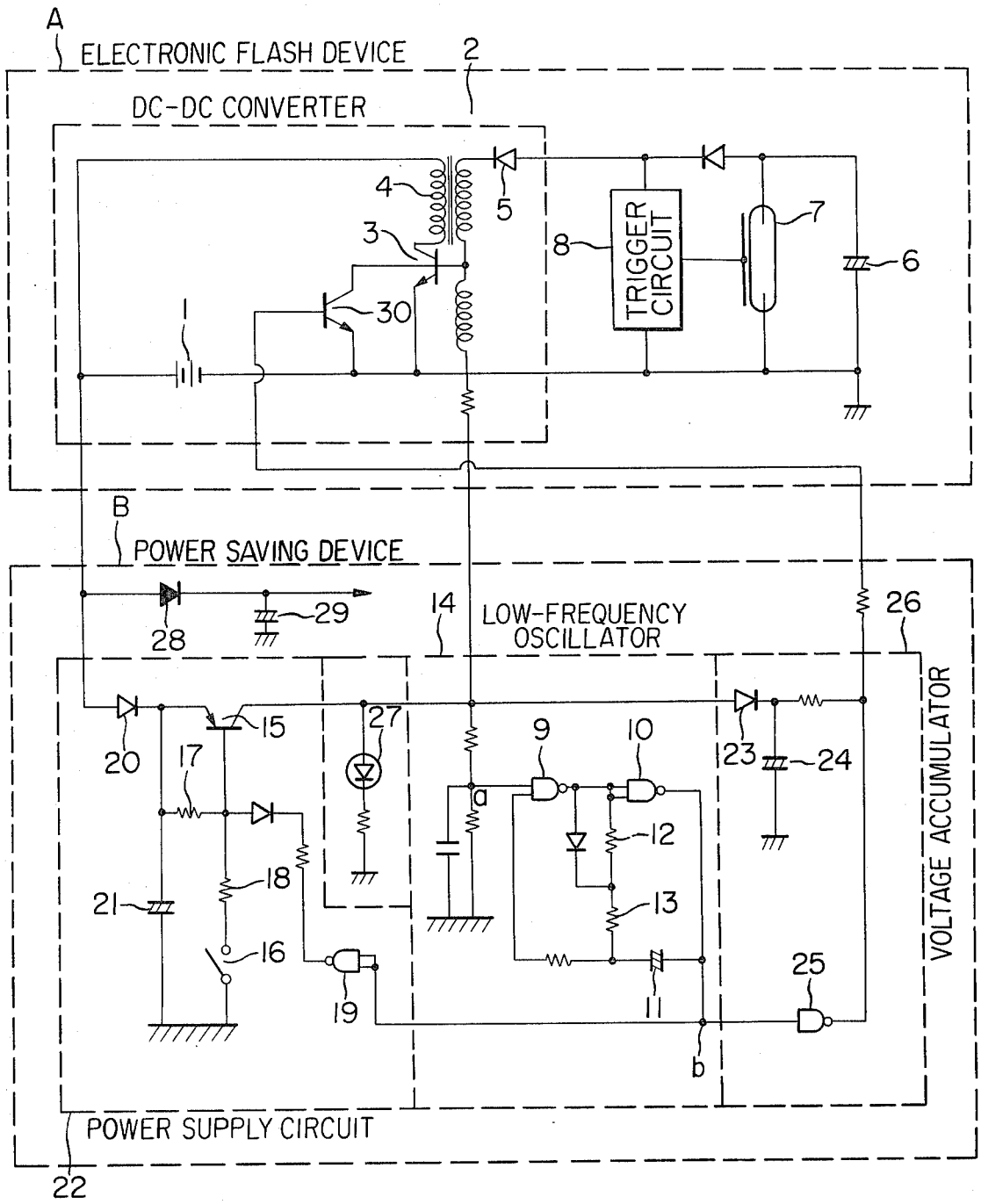
FIGS. 1-4 are circuit diagrams of first through fourth embodiments, respectively, in accordance with the present invention.

First Embodiment, FIG. 1

In FIG. 1 is shown a circuit diagram of a first embodiment of a power saving device in accordance with the present invention. For the sake of description of the present invention, a power supply comprising a power source and a DC-DC converter is used for an electronic flash device.

Reference numeral 1 designates a power source; 2, a DC-DC converter comprising the power source 1, an oscillation transistor 3, an oscillation transformer 4 and a rectifying diode 5; 6, a main flash capacitor; 7, an electronic flash lamp; and 8, a trigger circuit. These circuit components constitute an electronic flash device generally indicated by the reference letter A.

An extremely-low-frequency oscillator 14 comprises NAND gates 9 and 10, a capacitor 11 and resistors 12 and 13. A power on-off transistor 15 is controlled in response to the output from the low-frequency oscillator 14. A start switch 16 is the normally open type such as a push-on switch. A power supply circuit 22 comprises the power on-off or switching transistor 15, the normally-open type start switch 16, resistors 17 and 18, a NAND gate 19, a diode 20 and a capacitor 21. A voltage accumulator generally indicated by 26 comprises a diode 23, a capacitor 24 and a NAND gate 25.

A light-emitting diode 27 is turned on when the on-off transistor 15 is turned on. Reference numeral 28 denotes a diode; and 29, a capacitor which supplies power to the NAND gates 9, 10, 19 and 25 and which functions in such a way that the adverse effects due to the variations in voltage of the power supply 1 when a DC-DC converter 2 is just activated will not be felt by these NAND gates. A transistor 30 is controlled in response to the output from the power saving circuit generally indicated by B, thereby controlling the transistor 3 in the DC-DC converter 2.

It is apparent from FIG. 1 that the power source 1 always supplies power to the NAND gates 9, 10, 19 and 25. It is not preferable to use, as the NAND gates, IC gates comprising TTLs and/or IILs because they start to consume power immediately after the power source 1 is mounted. Therefore, the present invention uses NAND gates consisting of CMOS IC gates which will hardly consume current even when they are connected to the power source 1.

Next, the mode of operation of the electronic flash device with the above-described construction will be described. First, the start switch 16 is closed. Then, the voltage of the power source 1 is divided by the resistors 17 and 18 and a divided voltage is impressed across the base and emitter of the power on-off transistor 15. If this voltage is high enough to supply the base current to the power on-off transistor 15, that is, if the power source 1 is still usable, the transistor 15 is turned on so that a voltage substantially equal in level to that across the power source 1 is derived from the collector of the power on-off transistor 15 and applied to the extremely-low-frequency oscillator 14 and the voltage accumulator 26. Concurrently the light-emitting diode 27 is turned on to indicate that the above-described step has been completed.

On the other hand, if the divided voltage is so low that it cannot supply a sufficient base current to the power on-off transistor 15, the latter will not be turned on. As a result, no power is supplied from the power source 1 to the extremely-low-frequency oscillator 14 and the voltage accumulator 26 and the light-emitting diode 27 remains turned off. Therefore, the operator can notice that the power source 1 has been almost consumed and must be replaced with a new one.

When the voltage is supplied once through the power on-off transistor 15, the potential at the input terminal a of the low-frequency oscillator 14 goes high so that the output terminal also goes high, but the outputs from NAND gates 19 and 25 go low.

As a consequence, the base current can be kept supplied to the power on-off transistor 15 so that the latter is maintained turned on, but the transistor 30 is maintained in the nonconduction state. At the same time, the voltage of the power source 1 is continuously kept supplied across the base and emitter of the transistor 3 in the DC-DC converter 2 through the power on-off transistor 15 so that the oscillation transistor 3 is turned on. Thus, the DC-DC converter 2 is actuated. The voltage across the main flash capacitor 6 rises to a level which is dependent upon the turns ratio of the oscillation transformer 4 and at which the electronic flash lamp 7 can be flashed.

When the operator depresses the shutter release button or the like of a camera, the trigger circuit 8 causes the flash lamp 7 to flash, consuming the energy stored on the main flash capacitor 6. Thus, one flash exposure is made.

Next, the mode of operation of the power saving circuit B will be described in detail below. As described previously, when the start switch 16 is thrown in, the extremely-low-frequency oscillator 14 is activated so that the potential at the output terminal b which has been at a low level goes high. As a consequence, the outputs from the NAND gates 19 and 25 are reversed from a high level to a low level. As a consequence, the capacitor 11 is charged and while it is being charged, the extremely-low-frequency oscillator 14 is kept activated. When the capacitor 11 has been completely charged so that no charging current flows any longer, the input to the NAND gate 9 changes so that the output therefrom goes high from low and subsequently the output from the next stage NAND gate 10, that is, the potential at the output terminal b of the extremely-low-frequency oscillator 14 goes from high to low. As a consequence, the outputs from the NAND gates 19 and 25 change from a low level to a high level.

Then, the supply of the base current to the power on-off transistor 15 is interrupted so that the transistor 15 is turned off and consequently the supply of power from the power source 1 to the extremely-low-frequency oscillator 14 and the voltage accumulator 26 is interrupted. The light-emitting diode 27 is turned off.

Since the output from the NAND gate 25 goes high, the voltage stored across the capacitor 24 in the voltage accumulator 26 supplies the base current to the transistor 30 to turn it on.

The mode of operation will be further discussed mainly in conjunction with the oscillation transistor 3 in the DC-DC converter 2. As described previously, as soon as the capacitor 11 has been completely charged, the outputs from the NAND gates 19 and 25 are reversed so that the power source 1 is disconnected from the base of the oscillation transistor 3 and the base and emitter thereof are short-circuited through the transistor 30. As a result, the oscillation transistor 3 is turned off and consequently the DC-DC converter 2 is turned off. As a result, the energy consumption of the power source 1 is suppressed.

The capacitor 11 is charged when the start switch 16 is turned on. If the charging time interval of the capacitor 11 is predetermined, the energy consumption of the power source 1 is always cut off a predetermined time interval or charging time interval after the start switch 16 is closed. Thus, the wasteful consumption of the power source 1 which occurs when the operator forgets to turn off the on-off switch can be prevented. For instance, if the transistors 15 and 3 are turned off about a few minutes after the start switch 16 is closed, the supply of power from the power source 1 is interrupted without fail.

Figure 2:
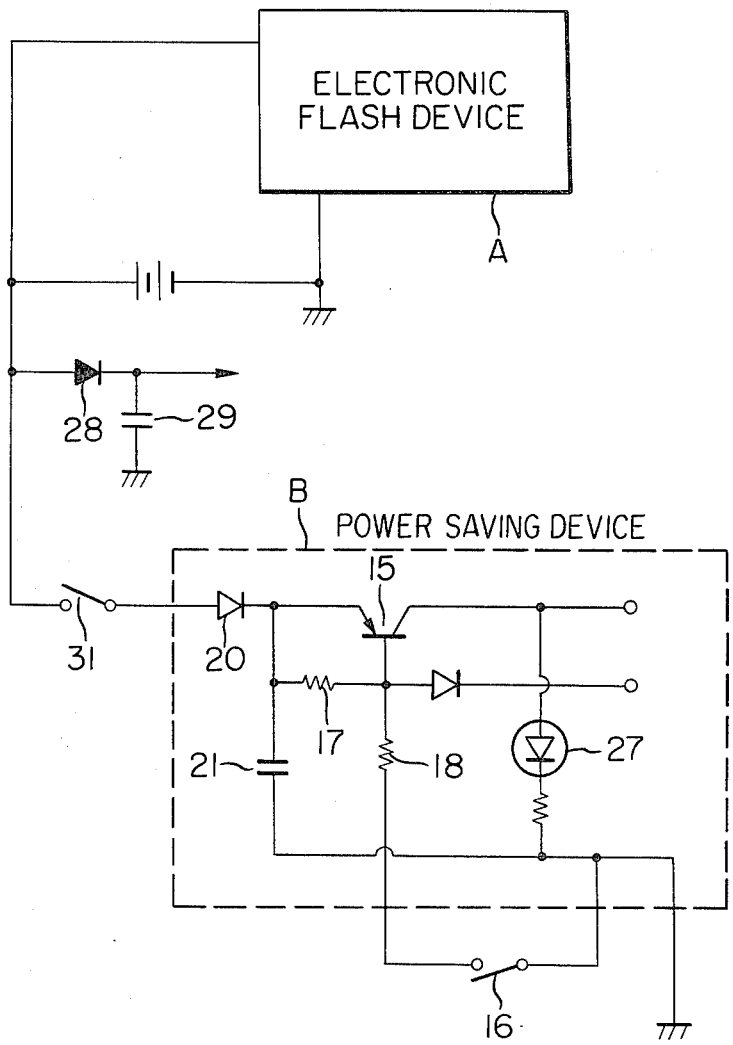

Second Embodiment, FIG. 2

In the first embodiment, the power supply from the power source 1 is interrupted a predetermined time interval, for instance, a few minutes after the start switch 16 is closed, that is, a time interval from the time when the start switch 16 is closed to the time when the capacitor 11 is completely charged. According to a second embodiment of the present invention, the supply of power from the power source 1 can be stopped at any time even before the capacitor 11 is completely charged as will be described in detail with reference to FIG. 2.

The second embodiment as shown in FIG. 2 is substantially similar in construction to the first embodiment described with reference to FIG. 1 except that a power on-off switch 31 is added between the power source 1 and the power supply circuit 22 in the power saving device B. When the power on-off switch 31 is turned off, the supply of power from the power source 1 to the power supply circuit 22 is interrupted. As a consequence, the power on-off transistor 15 is turned off and the potential at the output terminal b of the extremely-low-frequency oscillator 14 goes low even when the capacitor 11 is still charged. As a result, the DC-DC converter 2 is de-energized because the transistor 30 is turned on and the light-emitting diode 27 is turned off. Thus, the energy consumption of the power source 1 is interrupted.

In summary, according to the first and second embodiment of the present invention, when the start switch 16 is closed, the DC-DC converter 2 is turned on and concurrently the supply of power from the power source 1 to the extremely-low-frequency oscillator 14 and the voltage accumulator 26 is started, the oscillator 14 serving as a timer. After a predetermined charging time of the capacitor 11, which is a timer means, the power supply to the DC-DC converter 2 from the power source 1 is interrupted so that the converter 2 is forced to be turned off. The present invention, therefore, can eliminate the use of magnets and can provide the power saving device which is very simple in construction yet highly reliable in preventing wasteful use of power or energy.

According to the second embodiment, the power on-off switch 31 is interposed between the power source 1 and the power saving circuit B so that the conventional power on-off operation can be also utilized. Thus, the present invention has very high practical values.

As described previously, the extremely-low-frequency oscillator 14 is used to control a time interval during which the power supply is continued. Briefly stated, this oscillator 14 is used as a timer means so that it is, of course, possible to replace it with any other suitable timer means which is capable of accomplishing the same function.

Figure 3:
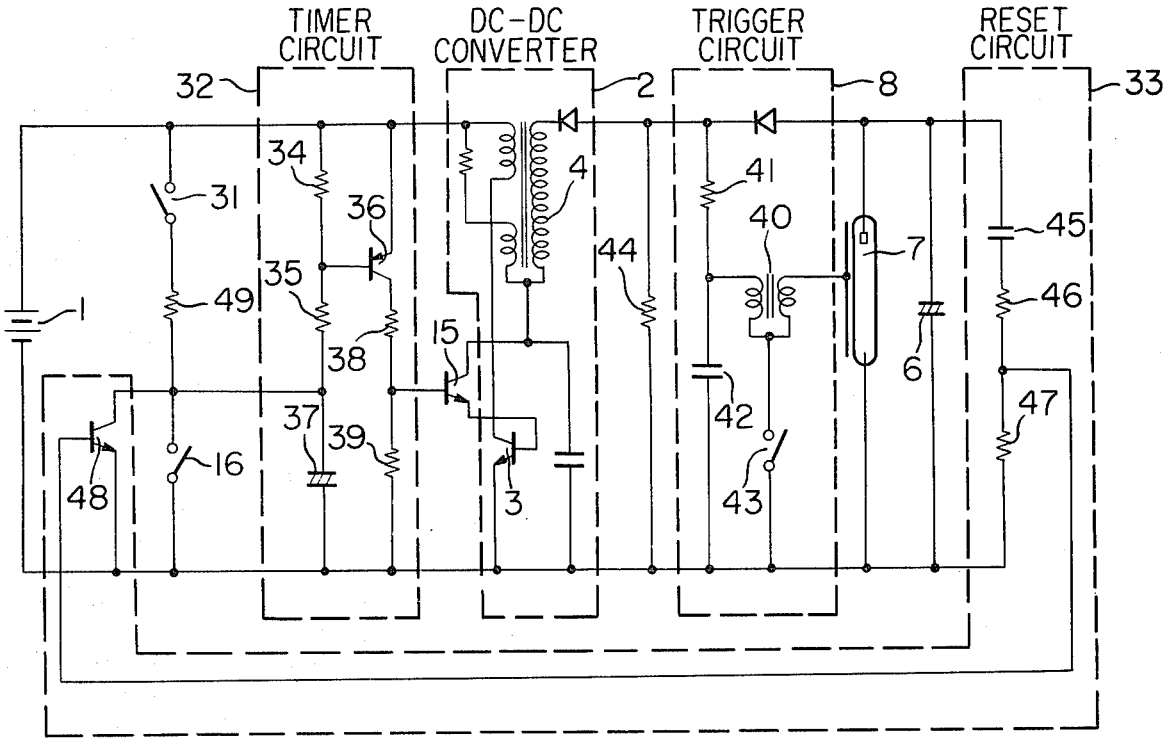

Third Embodiment, FIG. 3

A third embodiment of the present invention is also applied to an electronic flash system. It includes a timer circuit 32 comprising resistors 34, 35, 38 and 39, a transistor 36 and a capacitor 37; a reset circuit 33 consisting of a capacitor 45, resistors 46 and 47 and a transistor 48; a trigger circuit 8 comprising a transformer 40, a resistor 41, a trigger capacitor 42 and a synchronizing switch 43; and resistors 44 and 49.

The third embodiment is completely of the electronic type and serves to prevent the wasteful use of power. As compared with the first and second embodiments described above, the third embodiment is advantageous in that is has fewer component parts and that the wasteful power-consumption preventive means can be reset in response to the load as will be described in detail below.

When the start switch 16 is closed, the charge stored on the capacitor 37 through the resistors 34 and 35 from the power source 1 flows through the resistors 34 and 35. The current flows until the capacitor 37 is completely charged after the start switch 16 is returned to its initial state. To put into another way, the timer circuit 32 consisting of the resistors 34 and 35 and the capacitor 37 functions to flow the current through the resistors 34 and 35 for a predetermined time interval.

When the current flows through the resistors 34 and 35, the transistor 36 is turned on so that the current flows through the resistors 38 and 39. Then, the power on-off transistor 15 is turned on so that the current flowing through the transistor 15 is supplied as the base current to the oscillation transistor 3 in the DC-DC converter 2 to actuate it in a manner well known in the art.

Upon energization of the DC-DC converter 2, both the main flash capacitor 6, the trigger capacitor 42 and the capacitor 45 are charged. This charging operation continues until the capacitor 37 in the timer circuit 32 is completely charged, that is, until the time when the current flowing through the resistors 34 and 35 can not sustain the transistor 36 in the conduction state any longer. In other words, when a time interval determined by the timer circuit 32 has been elapsed, no base current is supplied to the oscillation transistor 3 so that the DC-DC converter 2 is turned off. Consequently all the capacitors except the trigger capacitor 42 start discharging and are returned to their initial states in which they are not charged at all. As is clear from FIG. 3, the trigger capacitor 42 is so connected that when the supply of energy from the DC-DC converter 2 is interrupted, the charge stored on it is immediately discharged through the resistors 41 and 44. Thus, according to the third embodiment, as soon as the DC-DC converter 2 is de-energized, the flash operation is locked, that is, it becomes possible to flash the flash lamp 7.

However, under the so-called charging condition when the DC-DC converter 2 is activated and the main flash capacitor 6 is charged sufficiently to flash the flash lamp 7, if the synchronizing switch 43 in the trigger circuit 8 is closed, the charge on the trigger capacitor 42 is discharged through the transformer 40 and the switch 43 so that a high voltage pulse induced across the secondary winding of the transformer 40 triggers the flash lamp 7, whereby the latter flashes, consuming the energy stored on the main flash capacitor 6.

So far, the fundamental mode of operation of the third embodiment has been described. If the supply of energy from the power source 1 can be instantaneously interrupted without causing the DC-DC converter 2 for a predetermined time interval when a flash exposure is suddenly stopped or the electronic flash device is retracted, the power source can be more effectively used. To this end, the lock switch 31 and the resistor 49 are provided.

When the lock switch 31 is closed, the capacitor 37 is connected across the power source 1 through the resistor 49. An extremely short time constant is selected so that as soon as the lock switch 31 has been closed, the capacitor 37 is immediately charged. That is, the timing operation of the timer circuit 32 is immediately completed so that the DC-DC converter 2 is turned off and consequently the wasteful power consumption can be avoided.

As described above, when the lock switch 31 is closed, the wasteful power consumption can be prevented However, if it is readily closed, many adverse effects result. It is, therefore, preferable that it is operatively interlocked to a shoe locking mechanism which controls the mounting of the electronic flash device on the camera in the case of the third embodiment.

Since the third embodiment is applied to the electronic flash device, the reset circuit 33 is provided. The object for preventing the wasteful use of the power source 1 can be accomplished by the provision of the timer circuit 32 and the lock switch 31 as described above. In general, the electronic flash lamp is repeatedly flashed so that if only the timer circuit 32 is provided, the start switch 16 must be closed every time when a flash exposure is to be made. As a consequence, the flash exposure operation becomes inconvenient or cumbersome. The reset circuit 33 is provided to eliminate such inconvenient or cumbersome operation.

As soon as the flash lamp 7 is fired, the charge stored on the capacitor 45 is discharged through the flash lamp 7 and the resistors 46 and 47 so that the voltage across the resistor 47 drops and consequently the transistor 48 is turned on which is connected in parallel with the capacitor 37. As a result, the charge on the capacitor 37 is immediately discharged and the circuit condition becomes the same as when the start switch 16 is closed. Therefore, the charging of the capacitor 37 is started and the DC-DC converter 2 is activated again.

As described above, the reset circuit 33 is provided so as to bring the timer circuit 32 to the state for starting the timing operation depending upon the mode of operation of the electronic equipment into which are incorporated the timer circuit 32 and the reset circuit 33. Thus, the above-described inconvenient or cumbersome operation can be avoided.

In summary, according to the third embodiment, the switching element and the timer circuit are inserted in to the loop for supply the base current to the oscillator transistor 3 in the DC-DC converter 2 so that a power consumption time interval can be limited, that is, the wasteful power consumption can be avoided. The system is entirely of the electronic control type so that the construction is very simple and consequently both the space and cost savings can be attained.

As described above, the third embodiment of the power saving device in accordance with the present invention is of the full electronic type so that the object for preventing the wasteful use of the power source can be accomplished by the simple construction. In addition, because of the full electronic type, the start switch may be a normally open switch. In contrast with the above-described prior art device which uses a magnet, it suffices to close the start switch only once to supply the power for a predetermined time interval. Therefore, when the power saving device of the present invention is applied to the electronic flash device as described hereinbefore in conjunction with FIGS. 1 through 3, an automatic setting device, which can automatically set the electronic flash device in operative condition in response to the brightness of a subject, can be made very simple in construction. Thus, the present invention is very advantageous when used in a camera with a built-in flash device.

More specifically, it is desired that the electronic flash device is controlled in response to the output signal from a brightness check circuit which senses the brightness of a subject. In the case of the prior art magnetic type, a switch is closed to check the brightness of a subject and is locked depending upon the detected brightness. As a result, as long as the output signal from the brightness check circuit exists, the switch will not be released. In other words, the output from the brightness check circuit keeps the magnet energized so that the supply of power from the power source to the magnet through the power saving circuit can not be controlled. As a consequence, a means which can control the output from the brightness check circuit to continue for a predetermined time must be added.

In the case of the "ON" type, the magnet must be kept energized even when the brightness of a subject is so high that the electronic flash device needs not to be actuated. As a result, the object for preventing the wasteful power consumption cannot be attained.

On the other hand, according to the present invention, it suffices to close the start switch only once to actuate the electronic flash device and the power supply. Therefore, if the brightness check circuit is so designed and constructed as to be actuated when the normally open switch or start switch 16 is closed and if an electronic switch which is controlled in response to the output signal from the brightness check circuit is used as the switch for starting the power saving device, there can be provided a means which can prevent the wasteful use of the power source, can ensure the extremely efficient use thereof and can remarkably simplify the use of the power source.

Figure 4:
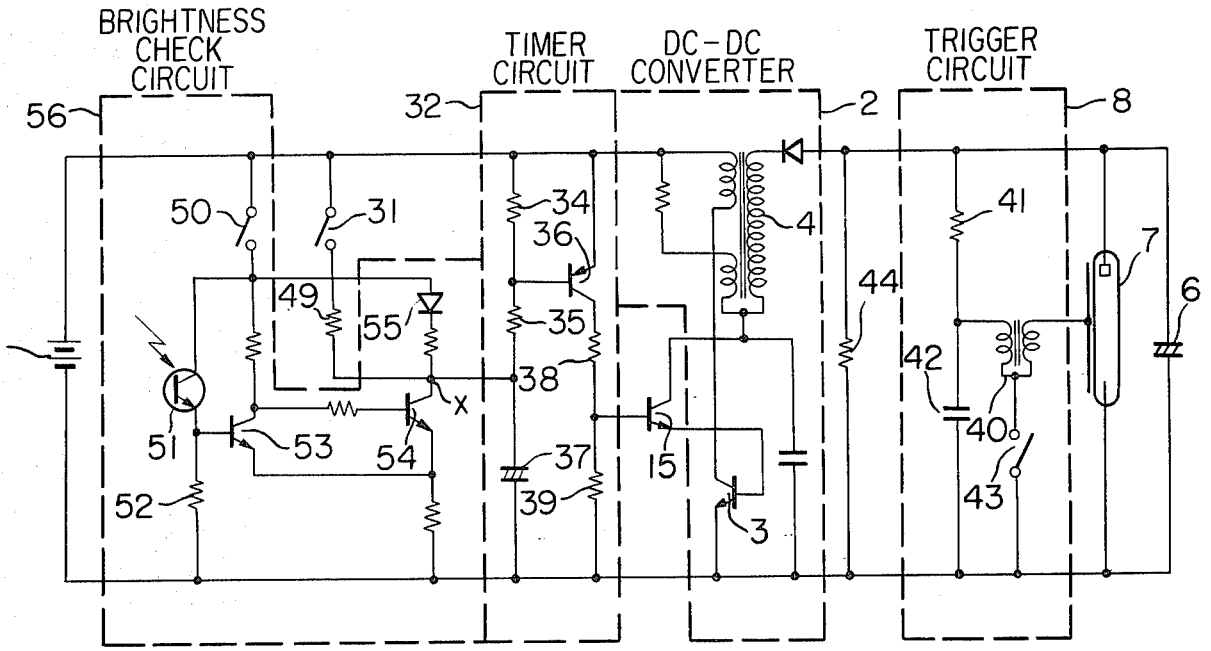

Fourth Embodiment, FIG. 4

The fourth embodiment of the present invention which will be described in detail below with reference to FIG. 4, was made to attain the above-described objects. More specifically, in the fourth embodiment the present invention is applied to an electronic flash device and is adapted to be actuated in response to the actuation of a brightness check circuit so that the overall operation can be much advantageously simplified.

The fourth embodiment shown in FIG. 4 is substantially similar in construction to the third embodiment shown in FIG. 3 except that there is provided a brightness check circuit 56 comprising a brightness check switch 50, a light sensor 51, a resistor 52, transistors 53 and 54 and a light-emitting diode, LED, 55.

The modes of operation of the timer circuit 32, the DC-DC converter 2, the trigger circuit 8 and the electronic flash lamp 7 are substantially similar to those of the third embodiment described in detail above with reference to FIG. 3 so that no description shall be made except that of the brightness check circuit 56.

When the brightness check switch 50, which is normally open, is closed, the power source 1 is connected to the brightness check circuit 56 to actuate it, thereby sensing the brightness of a subject. If the brightness of a subject is so high that it is not needed to fire the electronic flash lamp 7, the voltage drop across the resistor 52 is high enough to drive the transistor 53 into the conduction state. However, if the brightness of an object is too low, the voltage drop across the resistor 52 is so low as to keep the transistor 53 in the nonconduction state. More specifically, when the brightness of a subject is high, the transistor 53 is turned on as described above so that the transistor 54 remains turned off. As a result, the potential at the terminal X remains a potential voltage at which the capacitor 37 is charged through the resistors 34 and 35. On the other hand, when the brightness of a subject is low, the transistor 53 remains turned off so that the base current flows from the power source 1 through the switch 50 and the resistors to the transistor 54 to turn it on. As a consequence, the capacitor 37 is discharged and the potential at the terminal X drops to a low level.

If the brightness of a subject is low, the transistor 53 remains turned off while the transistor 54 is turned on so that the potential at the terminal X drops to a low level because the capacitor 37 is discharged as described above. As described in conjunction with the third embodiment, the timer circuit 32 is activated so that the DC-DC converter 2 is activated for a predetermined time interval.

When the transistor 54 is turned on, the light-emitting diode LED 55 is turned on so that the operator can recognize not only that the brightness of a subject is so low that a flash exposure must be made but also that the DC-DC converter 2 is being activated. In addition, the turned-on LED 55 indicates the time when the operator can open the normally open switch 50.

As described above, according to the fourth embodiment of the present invention, the power saving device can prevent the wasteful power consumption only when the brightness of a subject is low and subsequently a flash exposure is to be made. Therefore, the energy of the power source can be very effectively utilized without any wasteful loss.

As described previously, when the lock switch 31 is closed, the supply of power from the power source 1 is instantaneously interrupted. Therefore, as described previously, if it is readily or accidentally closed, some adverse effects result. That is, it is not preferable that the lock switch 31 is accidentally closed by an erratic operation. Therefore, it is preferable that the operation of the lock switch be interlocked with that of a shutter release locking mechanism which controls the depression of a shutter release button when the present invention is applied to the camera with an electronic flash device as with the case of the fourth embodiment.

In like manner, when the fourth embodiment is applied to a camera with a built-in electronic flash device, it is preferable that the switch 50 is so designed and constructed that it is closed when the shutter release button is half depressed. With these arrangements, the operation of the camera with an electronic flash device can be much simplified.

What is claimed is:

1. A power saving device for an electronic flash of the type having a DC power source (1) a DC-DC converter (2) comprising an oscillation transformer, an oscillation transistor and a rectifying diode for converting a low voltage supplied from said DC power source into a high DC voltage, a main discharge capacitor (6) which is charged with a high DC voltage supplied from said DC-DC converter, a flash lamp (7) which flashes by consuming the energy stored in said main discharge capacitor, and a trigger circuit (8) for causing said flash lamp to flash, said device comprising:

a first electronic switching element (15) series connected in a power supply circuit (22) source to said oscillation transistor in said DC-DC converter;

a normally open start switch (16) which, when closed, causes said first electronic switching element (15) to conduct;

a timer circuit (14) having a timing capacitor (11) and which is energized in response to the conduction of said first electronic switching element (15) so as to charge said timing capacitor (11) with energy supplied from said power source via said power supply circuit (22) said timing capacitor (11) being charged through a path separate from said oscillation transistor (3);

a first switching circuit (19), responsive to an output signal generated when the voltage charged across said timing capacitor (11) reaches a predetermined value, for turning off said first electronic switching element (15);

a voltage accumulator means (26) which is adapted to be connected to said DC power source through said electronic switching element (15) when said start switch (16) is closed, said voltage accumulator means (26) including a second switching circuit (25) whose output is changed when the voltage charged across said timing capacitor (11) of said timer circuit (14) reaches a predetermined value; and a control switching element (30) which is turned on in response to the change of the output from said second switching circuit (25) so that said oscillation transistor (3) is rendered non-conductive.

2. A power saving device as set forth in claim 1, further comprising a switch (31) for arbitrarily controlling the supply of power from said power source to said first electronic switching element 15.

3. A power saving device as set forth in claim 1, wherein said electronic switching element comprises a transistor (15) which is supplied with base current when said start switch is closed so that said transistor (15) is turned on and which is rendered nonconductive by said first switching circuit (19) when the base current is interrupted after a predetermined time interval which is set by said timer circuit.

4. A power saving device as set forth in claim 1, wherein said control switching element comprises a transistor (30) which is driven into the conduction state when supplied with base current from said voltage accumulator means (26), so that the base-emitter circuit of said oscillation transistor (3) is short-circuited by said control switching transistor (30).

5. A power saving device for an electronic flash comprising a DC power source, a DC-DC converter comprising an oscillation transformer, an oscillation transistor and a rectifying diode for converting a low voltage supplied from said DC power source into a high DC voltage, a main discharge capacitor which is charged with a high DC voltage supplied from said DC-DC converter, a flash lamp which flashes by consuming the energy stored in said main discharge capacitor, and a trigger circuit for causing said flash lamp to flash, said device comprising:

a first electronic switching element (15) for supplying base current from said power source to an oscillation transistors in said DC-DC converter (2);

a start switch (16) which is normally open and which, when closed, causes said electronic switching element (15) to conduct;

a capacitor (37) which is adapted to be charged through resistor means (34,35) by said power source (1) and which is connected in parallel with said start switch (16);

a second switching element (36) which is driven into the conduction state when current flows through said resistor means (34,35), thereby driving said electronic switching element (15) into the conduction state, whereby said DC-DC converter is kept energized only when current is flowing through said resistor means (34,35) to charge said capacitor (37), said start switch (16) comprising a third electronic switching element (54) which in turn is controlled by a normally open start switch (50);

a brightness check circuit (56) comprising a light sensor (51) connected to said power source when said normally open switch (50) is closed, so as to sense the brightness of a subject; and a switching circuit comprising a fourth electronic switching element (53) which is controlled in response to the output from said light sensor so as to cause said capacitor (37) to be discharged when the brightness of a subject is so low that said electronic flash lamp must be fired, whereby when the brightness of a subject is less than a predetermined value, said DC-DC converter is kept energized during the time when said capacitor is charged and current flows through said resistor means (34,35).

* * * * *